United States Patent [19]

Craven et al.

[11] 4,042,779

[45] Aug. 16, 1977

[54] COINCIDENT MICROPHONE SIMULATION COVERING THREE DIMENSIONAL SPACE AND YIELDING VARIOUS DIRECTIONAL OUTPUTS

[75] Inventors: Peter Graham Craven, Headington; Michael Anthony Gerzon, Oxford, both of England

[73] Assignee: National Research Development Corporation, London, England

[21] Appl. No.: 593,244

[22] Filed: July 7, 1975

[30] Foreign Application Priority Data

July 12, 1974 United Kingdom ..... 30977/74

[51] Int. Cl.[2] ..... H04R 1/20

[52] U.S. Cl. ..... 179/1 DM

[58] Field of Search ..... 179/1 AT, 1 DM, 1 G, 179/1 GA, 1 GP, 1 GQ, 15 BT, 100.1 TD, 139; 340/8 R, 9, 13 R

[56] References Cited

U.S. PATENT DOCUMENTS

| | | | |
|---|---|---|---|
| 2,636,943 | 4/1953 | Schaeffer | 179/1 G |
| 3,158,695 | 11/1964 | Camras | 179/1 G |
| 3,290,646 | 12/1966 | Ehrlich et al. | 340/8 R |
| 3,360,606 | 12/1967 | Ratliff, Jr. | 179/1 GQ |
| 3,824,342 | 7/1974 | Christensen et al. | 179/1 GQ |

FOREIGN PATENT DOCUMENTS

| | | | |
|---|---|---|---|
| 604,080 | 4/1960 | Italy | 179/1 GA |

*Primary Examiner*—George G. Stellar
*Attorney, Agent, or Firm*—Cushman, Darby & Cushman

[57] ABSTRACT

A microphone assembly for simulating a plurality of coincident microphones has at least four microphone units mutually disposed at the integration points of an integration rule for the surface of a sphere. In one embodiment, four such microphone units are disposed on respective faces of a regular tetrahedron.

8 Claims, 2 Drawing Figures

Figure 1:
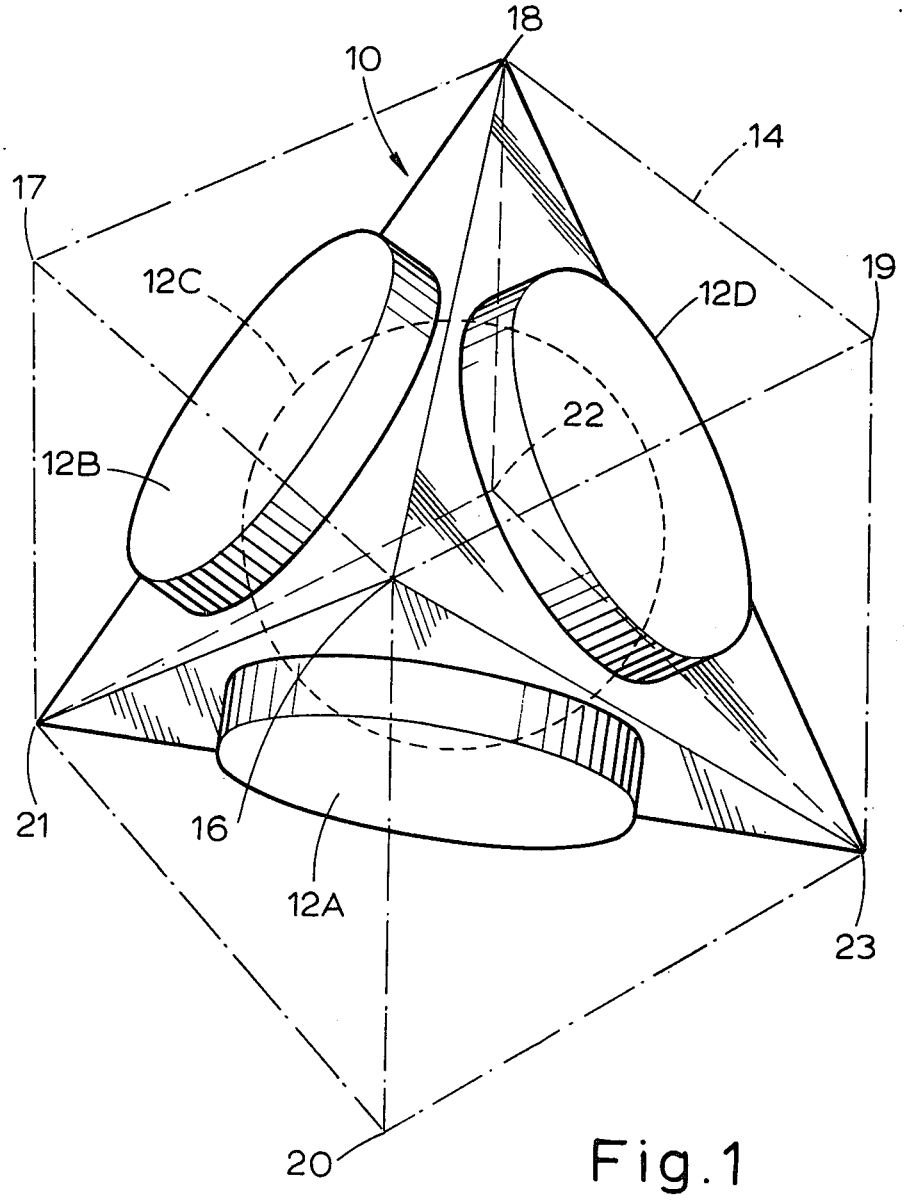

COINCIDENT MICROPHONE SIMULATION COVERING THREE DIMENSIONAL SPACE AND YIELDING VARIOUS DIRECTIONAL OUTPUTS

This invention relates to microphone assemblies and is particularly concerned with microphone assemblies for providing output signals equivalent to the outputs which would be obtained from a plurality of coincident microphones.

The provision of coincident microphones, where two or more microphones having different directional characteristics are at the same location, is a fairly common requirement. For example, a coincident microphone technique can be used to provide signals for the sound reproduction systems described in copending U. S. Applications Ser. Nos: 430519 and 560865. However, it will be appreciated that it is not physically possible to have two separate microphones at precisely the same location. There will, inevitably, be some differences in position. It is an object of the present invention to provide a microphone assembly for providing outputs equivalent to the outputs which would be obtained from a plurality of coincident microphones having different directional characteristics.

According to the invention, there is provided a microphone assembly for providing outputs equivalent to the outputs which would be obtained from a plurality of coincident microphones, the directional response curve of each such coincident microphone being a respective spherical harmonic, said microphone assembly comprising at least four microphone units mutually disposed at the integration points of an itegration rule for the surface of a sphere, as hereinafter defined, and matrix means having a respective summing means for each desired spherical harmonic and means for applying the output of each microphone unit to said summing means with a gain proportional to the weight of said integration rule corresponding to the integration point at which said microphone unit is located and a further gain equal to the magnitude of said spherical harmonic in the direction of maximum response of said microphone unit.

The term "an integration rule"is used herein to mean a numerical rule which substantially exactly integrates, over the surface of a sphere, all spherical harmonics of order up to twice the highest order spherical harmonic for which a directional response curve is required. Suitable integration rules are described in A. H. Stroud, "Approximate Calculation of Multiple Integrals", Prentice-Hall Inc. 1971, see especially Chapter 8. In practice, the number of integration points is equal to the number of microphone units.

Up to a limiting frequency, a microphone circuit in accordance with the invention gives directional response curves which are independent of frequency. Although the overall gain and phase shift may be frequency dependent, compensation for this can readily be provided. All spherical harmonics of the same order have the same frequency response. Consequently, only one equalisation characteristic is required for each order of spherical harmonics.

If the integration rule is such that the integration points, and therefore the microphone unit locations are at the centres of the faces of a regular solid, all the weights are equal. It should be understood that the term "solid" as used herein means a three dimensional shape and does not necessarily mean that such a body is physically present.

In a preferred embodiment of the invention, where only zero order and first order harmonics are required, a tetrahedral integration rule is used. Consequently, there are four microphone units and each of these is located on a respective face of a regular tetrahedron. Since this tetrahedron is a regular solid, the gains of all the microphone units are equal.

Figure 2:
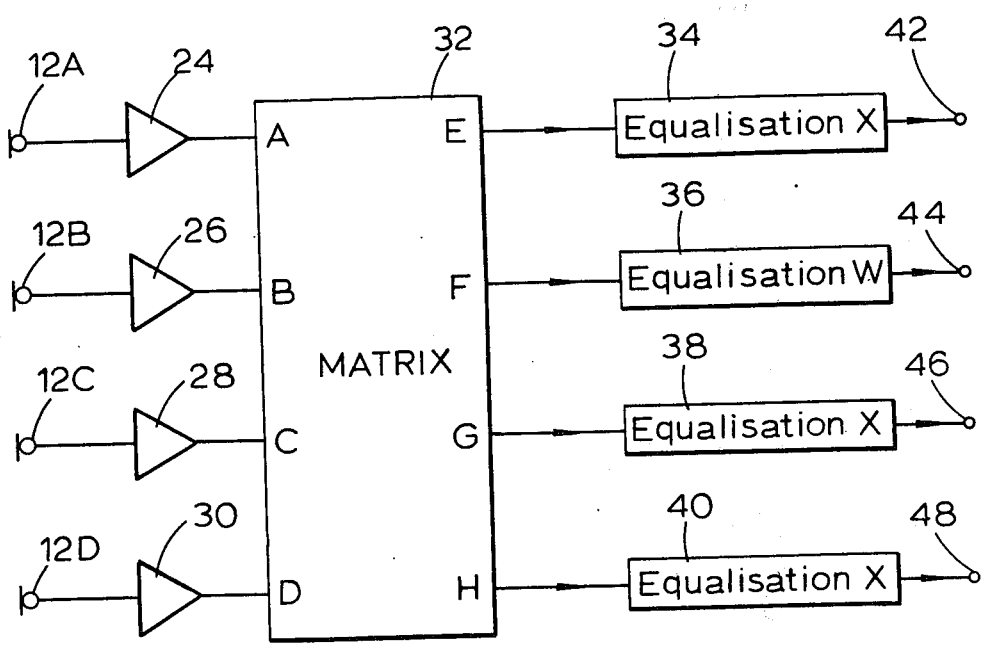

An embodiment of this preferred form of the invention will now be described, by way of example, with reference to the accompanying drawings, in which:

FIG. 1 is a perspective view of a microphone assembly in accordance with the invention; and FIG. 2 is a block diagram illustrating the electrical connections of the microphone assembly shown in FIG. 1.

Referring first to FIG. 1, a tetrahedron 10 has four microphone capsules 12A, 12B, 12C and 12D each mounted on a respective face thereof. The tetrahedron 10 is shown for convenience of representation and it should be understood that in practice adjacent edges of the capsules 12A, 12B, 12C and 12D touch and are joined together so that if their back surfaces were extended, they would form a tetrahedron. The tetrahedron 10 is shown as enclosed within an imaginary cube 14 which provides a frame of reference. The tetrahedron 10 is orientated so that the face of the cube bounded by the corners 16, 17, 18 and 19 is at the top, the face bounded by the corners 17, 18, 22 and 21 is at the front and the face bounded by the corners 17, 16, 20 and 21 is at the left.

Each of the microphone capsules 12A, 12B, 12C and 12D has a directional response of the form $(1 + k \cos \theta)$, for example cardioid or hypercardioid, where $k$ is a constant for each frequency. The axis of symmetry of the directional response of each microphone is perpendicular to the corresponding face of the tetrahedron 10. Thus the maximum response directions of the microphones are as follows.

| Microphone | Direction of Maximum Response |
|---|---|
| 12A | left back down |
| 12B | left front up |
| 12C | right front down |
| 12D | right back up |

Referring to FIG. 2, the outputs from the microphones 12A, 12B, 12C and 12D are connected via respective amplifiers 24, 26, 28 and 30 to a matrix 32. As already explained, since a tetrahedron is a regular solid, the gains of the amplifiers 24, 26, 28 and 30 are equal.

The matrix 32 is arranged to produce four output signals E, F, G and H from the four input signals A, B, C and D from the amplifiers 24, 26, 28 and 30 respectively. The output signal F is the zero order harmonic and is therefore an omnidirectional signal, i.e. equivalent to that which would be produced by a microphone with a spherical directional response curve. The remaining three signals E, G and H are first order spherical harmonics and therefore correspond to the signals which would be produced by microphones having figure-of-eight directional response curves. The direction of maximum sensitivity for the output signal E is front to back, for the output signal G is left to right and for the output signal H is up and down. The actual operation of the matrix 32 is as follows:

$$E = \tfrac{1}{2}(-A + B + C - D)$$

$$F = \tfrac{1}{2}(A + B + C + D)$$
$$G = \tfrac{1}{2}(A + B - C - D)$$
$$H = \tfrac{1}{2}(-A + B - C + D)$$

It is now necessary to equalise the signals E, F, G and H so that the relative frequency and phase response is the same in all directions to which the corresponding microphones respond. As already explained, all spherical harmonics of the same order have the same frequency and phase response. Consequently, it is necessary to apply one equalisation characteristic to the zero order signal F and another to the first order signals E, G and H.

It will be assumed that the shape of the "figure-of-eight" response required is such that the maximum gain is $\sqrt{2}$ times the omnidirectional gain. This shape has the advantage that approximately equal signal levels are produced in all four channels so that no one channel is required to handle excessively high signal levels. With this shape, if the microphones have perfect cardioid response and are "acoustically transparent" so that they do not interfere with one another, the ratio of the gain of the zero order signal F to that of the first order signals E, G and H is $\sqrt{6}$ at middle frequencies (e.g. 1 kHz) the optimum theoretical equalisation characteristics W and X for the zero order omnidirectional signal and the first order figure-of-eight signals over the required frequency range being substantially as follows:

$$W = \frac{1 + j\omega\tau - \tfrac{1}{3}\omega^2\tau^2}{1 + \tfrac{1}{3}j\omega\tau}$$

$$X = \sqrt{6}\left(\frac{1 + \tfrac{1}{3}j\omega\tau - \tfrac{1}{3}\omega^2\tau^2}{1 + \tfrac{1}{3}j\omega\tau}\right)$$

where $\pi = (r/c)$ $r$ = effective distance of centre of microphone capsules 12 from centre of tetrahedron 10

$c$ = speed of sound $\omega$ = angular frequency

In practice, the equalisation should preferably be performed so as to provide an appropriate flat energy response with respect to frequency in the audio range when the microphone assembly is exposed to a statistically uniform random inhomogeneous sound field, for example approximately reverberant sound. This condition is fulfilled if the frequency characteristic of the matrix at the lower frequency end of the audio range is in accordance with the equalisation characteristics described above, but at the higher frequency end of the audio range, for the first order figure-of-eight signals, the decrease in response relative to the mid-frequency response (e.g. 1 kHz), as frequency increases is limited to a factor of approximately $1/\sqrt{3}$ and, for the zero order omnidirectional signal, the corresponding increase is limited to a factor of $\sqrt{3}$.

Any of the well know filter circuits providing the above frequency responses can be used. In order to obtain maximum flatness of response to statistically uniform random inhomogeneous sound fields, it may be desirable for the pivot frequency of the filter for the omnidirectional signal to differ from that of the filters for the figure-of-eight signals, as discussed in M. A. Gerzon "Design of Precisely Coincident Microphone Arrays for Stereo and Surround Sound", Audio Engineering Society, Proceedings of 50th Convention, London, 1975.

To effect this equalisation, the output signals E, F, G and H from the matrix 32 are connected to respective equalisation units 34, 36, 38 and 40. Equalisation unit 36 has characteristic W and the equalisation units 34, 38 and 40 have characteristic X. The output signal of terminal 44 is then the required equalised omnidirectional signal and the output signals on terminals 42, 46 and 48 are the equalised figure-of-eight signals giving front to back, left to right and up and down information respectively. If the signals are to be replyed through a horizontal two-dimensional oud speaker layout, such as described in copending U.S. Applications Ser. Nos: 430519 and 560865 mentioned above, the output signal from terminal forms the omnidirectional signal and the azimuth signal is formed by applying a phase shift of 90° to the output signal from terminal 46 and adding it to the output signal from terminal 42. The output signal from the terminal 48, which would give height information, is not used and consequently the corresponding equalisation unit 40 need not be provided.

The output signals from the terminals 42, 44, 46 and 48 may be matrixed to provide any desired polar diagram or diagrams consisting of zero and first order harmonic components. Alternatively, the matrix 32, the equalisation units 34, 36, 38 and 40 and any such subsequent matrixing stage may be replaced by any linear frequency dependent matrix which produces the required final output signals.

So long as the equalisations W and X are suitable adjusted, the operation of the microphone assembly is not affected by objects in its vicinity which have spherical symmetry. For example, the microphones could be mounted on the surface of a hard sphere. Similarly, it may be convenient to handle different frequency bands with microphones arranged on shells of different radius each with its own associated circuitry, the resultant outputs being combined by crossover networks. Provided the outer shell or shells are basically spherically symmetrical, they will not adversely affect the operation of the microphones on the innermost shell.

The microphones may have a linking acoustical network which shares the symmetry of the microphone assembly.

We claim:

1. A microphone assembly for providing outputs corresponding to at least zero order and first order harmonics equivalent to the outputs which would be obtained from a plurality of coincident microphones, the directional response curve of each coincident microphone being a respective spherical harmonic, said microphone assembly comprising at least four microphone units mutually disposed at the integration points of an integration rule for the surface of a sphere, as hereinbefore defined, matrix means having a respective combining means for each desired spherical harmonic including a first combining means for said zero order harmonics and a second combining means for said first order harmonics, means for applying the output of each microphone unit to said combining means with a gain proportional to the weight of said integration rule corresponding to the integration point at which said microphone unit is located and a further gain equal to the magnitude of said spherical harmonic in the direction of maximum response of said microphone unit, first equalisation means connected to said first combining means for applying an equalisation to the output thereof and a second equalisation means connected to said second combining means for applying an equalisation to the output thereof, the equalisation being such that all outputs of each said equalisation means have substantially the same frequency response to sounds from all directions up to a limiting frequency and are substantially identical to the outputs obtained from a plurality of coincident microphones.

2. A microphone assembly as claimed in claim 1, in which the equalisation means is arranged to apply equalisations such that all outputs therefrom have substantially the same phase response to sounds from all directions up to a limiting frequency.

3. A microphone assembly as claimed in claim 2, in which each microphone unit has a directional response of the form $(1 + k \cos \theta)$, where $k$ is a constant for each frequency.

4. A microphone assembly as claimed in claim 2, in which said microphone units are located at the centres of the faces of a regular solid.

5. A microphone assembly as claimed in claim 4, having four microphone units each of which is located at the centre of a respective face of a regular tetrahedron.

6. A microphone assembly as claimed in claim 5, in which the combining means are arranged to produce a zero order output signal F and three first order output signals E, G and H from four input signals A, B, C and D as follows:

$$E = \tfrac{1}{2}(-A + B + C - D)$$
$$F = \tfrac{1}{2}(A + B + C + D)$$
$$G = \tfrac{1}{2}(A + B - C - D)$$

$$H = \tfrac{1}{2}(-A + B - C + D)$$

7. A microphone assembly as claimed in claim 5, in which the equalisation means includes an equalisation unit for the zero order output signal having a characteristic:

$$W = \frac{1 + j\omega\tau - \frac{1}{3}\omega^2\tau^2}{1 + \frac{1}{3}j\omega\tau}$$

and a respective equalisation unit for each of the first order output signals having a characteristic:

$$X = \sqrt{6}\left(\frac{1 + \frac{1}{3}j\omega\tau - \frac{1}{3}\omega^2\tau^2}{1 + \frac{1}{3}j\omega\tau}\right)$$

where $\tau = (r/c)$ $r$ = effective distance of centre of microphone capsules from centre of tetrahedron.

$c$ = speed of sound $\omega$ = angular frequency

8. A microphone assembly as claimed in claim 7, having four microphone units, each of which is located at the centre of a respective face of a regular tetrahedron, the equalisation means being so arranged that, at the upper frequency end of the audio range, the increase in response for the zero order signals is limited to a factor of $\sqrt{3}$ and the corresponding decrease in response for the first order signals is limited to $1/\sqrt{3}$.

* * * * *